United States Patent [19]

Dalebout et al.

[11] Patent Number: 4,684,126

[45] Date of Patent: Aug. 4, 1987

[54] GENERAL PURPOSE EXERCISE MACHINE

[75] Inventors: William T. Dalebout, Portland, Oreg.; Sohrab Vassoughi; William J. Martinell, both of Vancouver, Wash.; David C. Rohrer, Gaston, Oreg.; Steven W. Martinell, Vancouver, Wash.; Robert L. Marchant, Portland, Oreg.

[73] Assignee: Pro Form, Inc., Beaverton, Oreg.

[21] Appl. No.: 815,750

[22] Filed: Dec. 31, 1985

Related U.S. Application Data

[63] Continuation of Ser. No. 645,497, Aug. 29, 1984, abandoned.

[51] Int. Cl.[4] ..... A63B 21/00

[52] U.S. Cl. ..... 272/134; 272/72; 272/132

[58] Field of Search ..... 272/72, 73, 93, 130–132, 272/134, 136, 142; 128/28 R

[56] References Cited

U.S. PATENT DOCUMENTS

| | | | |
|---|---|---|---|
| 1,868,262 | 7/1932 | Staley | 272/72 |
| 2,145,940 | 2/1939 | Marlowe | 272/72 |
| 2,565,348 | 8/1951 | Brockman et al. | 272/73 |
| 3,298,688 | 1/1967 | Grzybowski | 272/142 X |
| 3,359,802 | 12/1967 | Sollenberger | 272/130 X |
| 3,712,613 | 1/1973 | Feather et al. | 272/134 X |
| 3,893,667 | 7/1975 | Snyder, Jr. et al. | 272/131 |
| 3,976,058 | 8/1976 | Tidwell | 128/25 R |
| 4,240,627 | 12/1980 | Brentham | 272/130 |
| 4,465,274 | 8/1984 | Davenport | 272/130 |
| 4,471,957 | 9/1984 | Engalitcheff, Jr. | 272/130 X |
| 4,478,411 | 10/1984 | Baldwin | 272/118 |
| 4,550,908 | 11/1985 | Dixon | 272/130 |

FOREIGN PATENT DOCUMENTS

| | | | |
|---|---|---|---|
| 442103 | 1/1968 | Switzerland | 272/72 |
| 403165 | 12/1933 | United Kingdom | 272/72 |
| 895469 | 1/1982 | U.S.S.R. | 272/72 |

*Primary Examiner*—Richard J. Apley
*Assistant Examiner*—Robert W. Bahr
*Attorney, Agent, or Firm*—Klarquist, Sparkman, Campbell, Leigh & Whinston

[57] ABSTRACT

An exercise machine having a frame supporting a seat in an off-the-floor position. A pair of arm levers are mounted on the frame and provide resistance to movement in two directions, with the resistance to pushing from rest positions being less than the resistance to pulling to return the arms to the rest positions. The machine has a pair of leg levers wherein resistance to movement in a pushing direction is greater than in a pulling direction. The resistance to movement of the exercising levers is provided by friction mechanisms and springs, with the frictional force being greater than the spring force. The friction mechanisms offer the same resistance in either direction of movement, but the springs aid movement of the arm levers in push, when returning them to rest positions, while aiding the foot levers in a pulling direction. The arm levers have grips rearwardly inclined from the main portions thereof for better in-line application of force by the user. The seat is rearwardly tilted to a position where hyperextension of the legs is prevented. The seat can also be adjusted fore and aft to accommodate variation in user size.

1 Claim, 3 Drawing Figures

GENERAL PURPOSE EXERCISE MACHINE

This application is a continuation of application Ser. No. 645,497, filed Aug. 29, 1984, now abandoned.

This invention relates to a general purpose exercise machine.

There are many types of such machines, including, for instance, stand type cycles, for exercising the legs by way of pushing resistance to pedal movement. A few of such machines have incorporated a limited amount of upper body movement. Then there are rowing machines for exercising the legs in pushing resistance and the arms in pulling resistance. Finally, there are a number of different types of weight machines or spring-resistance machines for the arms or the legs.

The above types of machines have limitations as will be apparent from the following objects and description.

It is a main object of the present invention to provide an exercising machine in which the arms and legs are all exercised at the same time, and wherein resistance is achieved in both pulling and pushing directions of movement.

Another important object of the invention is to provide such a machine in which resistance to movement is differential, being greater for the legs in push than pull, but greater for the arms in pull than push.

Still another important object is to provide such a machine in which exercising is carried out from an off-the-floor seated and back supported position for convenience in use, and support of the lumbar region.

It is a further object of the invention to provide a machine as recited above which can simulate a rowing machine with the arms as well as the legs work together, or simulate cross country skiing, wherein the right arm and leg can be moved oppositely from the left arm and leg.

A still further object is to provide such a machine in which the resistance to movement can be varied to fit the desires and demands of the user.

Various other objects of the invention will be apparent from the following description taken in connection with the accompanying drawings wherein.

DESCRIPTION OF THE PREFERRED EMBODIMENT

Figure 1:
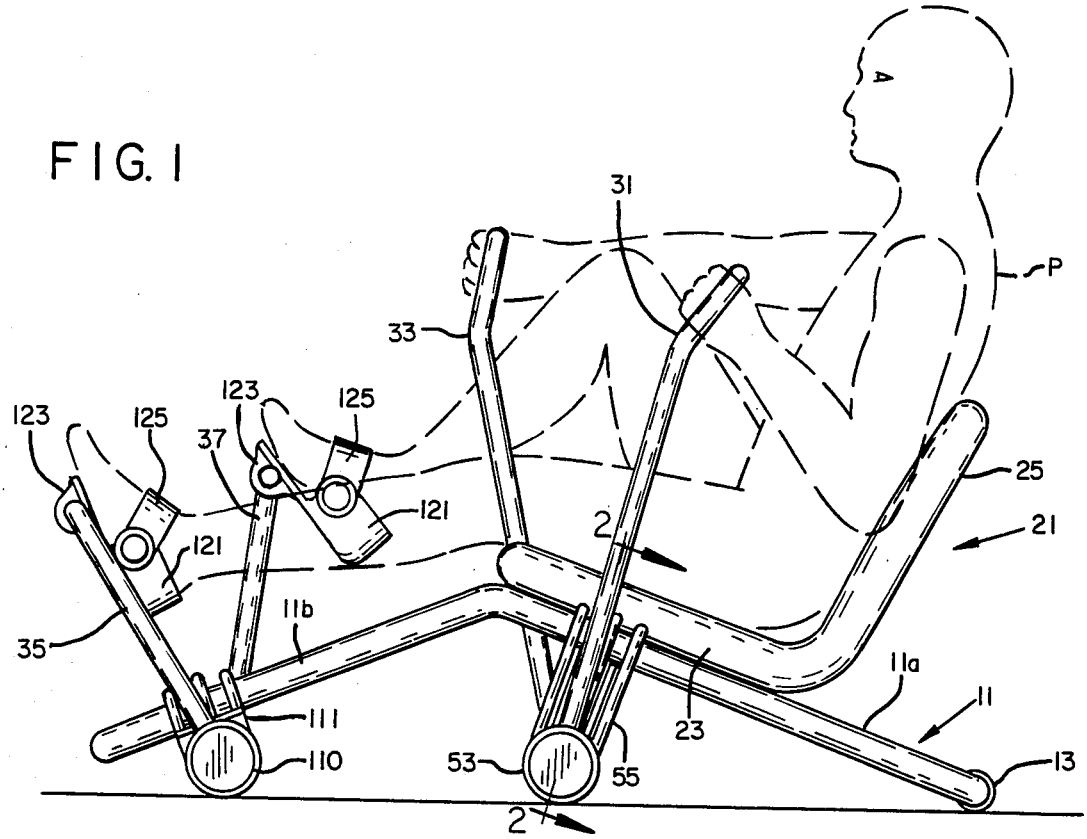
FIG. 1 is a side elevation of a machine of the present invention.

In the particular embodiment shown, the exercise machine comprises a tubular frame 11, which in plan is of rectangular loop shape. In side elevation the frame is of inverted spread V shape, having an upwardly inclined rear portion 11*a*, and a downwardly inclined front portion 11*b*, viewed from the position of the person using the machine. Suitable annular pads 13 are provided on the rear end portion of the frame for support contact with the floor. The front of the frame is supported in a manner to be presently described.

There is a seat generally entitled 21 having a seat portion 23 and a back rest portion 25 rigidly connected together. The seat is padded for comfortable contact by the user, and is secured to the upper part of the rear frame portion, and thus is tilted slightly clockwise from an erect position. This receives the person's body in a comfortable position for substantial support for the lumbar region.

Arm exercises are effected through a pair of arm levers 31 and 33, while the leg exercises are effected through a pair of leg levers 35 and 37. Each set of levers is mounted and operates in a similar fashion, so only the arm arrangement will be described in detail.

Figure 2:
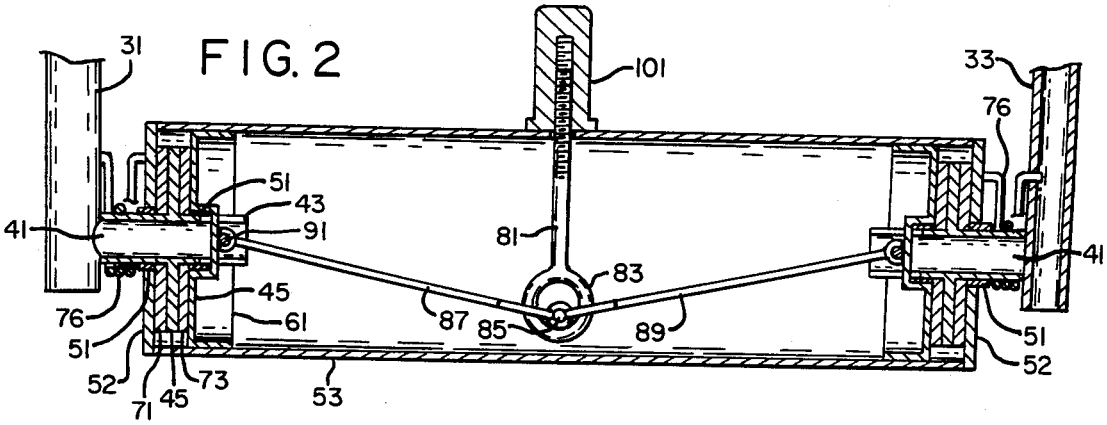
FIG. 2 is a cross section through FIG. 1 on line 2—2.

Referring to FIG. 2, arm 31 is provided with a fixedly and laterally projecting trunnion axle 41 non-rotatably received by a sleeve 43 of a disc unit having a friction disc 45 projecting radially from the sleeve intermediate the ends thereof. The sleeve 43 is rotatably mounted by journals 51, one of the journals being carried by an end cap or head 52 of a tubular frame member 53. The tubular frame member extends from side to side of the exercise machine and is secured by hangers 55 (FIG. 1) to the frame 11.

The inner portion of the sleeve 43 rotatably extends through the other journal 51, which is carried by an adjustment disc 61. The adjustment disc is slidably received within the interior of the tubular frame member 53 for movement toward and away from the head 52. The disc has a keyed sliding fit with member 53.

Sandwiched between the friction disc 45 and the head 52, on one side, and the adjustment disc 61 on the other, are a pair of annular friction elements or pads 71 and 73.

A torsion spring 76 encircles the trunnion 41 and sleeve 43, and is connected at its outer end to the lever 31 and at its inner end to the head 52. The direction of coil is such that the spring resists clockwise movement of lever 31 (FIG. 1), but aids movement in the opposite direction.

As is evident from FIG. 2, there is a similar arrangement, to that described above, for the right hand arm lever 33.

Between the opposite ends of the tubular frame member 53 is an adjustment member 81 slidably supported for vertical movement by the support drum. The adjustment member 81 has an eye 83 at its lower end, provided with a pivot 85 rockably receiving a pair of adjustment rods 87 and 89. The rods extend outwardly and upwardly from the eye 83. The outer end of each rod rockably engages a pivot pin 91 carried by the associated adjustment disc 61.

Instead of an eye 83, preferably the lower end of adjustment member 81 carries a pin (not shown) of which the inner ends of the rods 87 and 89 rock, much as they do on the pins 91.

Figure 3:
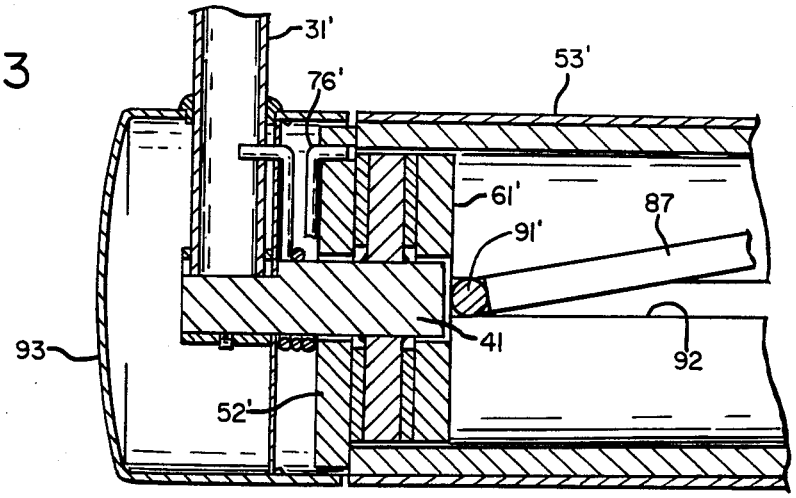
FIG. 3 is a cross section like FIG. 2 but of a preferred arrangement.

FIG. 3 shows a preferred form of pushing arrangement wherein the pin 91' rides in a pair of grooves formed in tubular frame member 53', one groove 92 being shown. The rods fixedly carry their pins, as shown for rod 87 in FIG. 3. The pin 91' bears against the inner end face of a compression element 61', sufficient clearance being provided between the pin and the end of stub shaft 41' so that the pin does not abut against the shaft.

FIG. 3 shows that the rods may be arranged to extend downwardly from the adjustment member, rather than upwardly, as in FIG. 2, but the FIG. 2 arrangement is the preferred one, insofar as the up or down inclination of the rods is concerned.

FIG. 3 shows that a cover 93 may be provided for aesthetic purposes.

Returning again to FIG. 2, a screw type adjustment means at 101 enables the adjusting member 81 to be moved upwardly, enabling the rods 87 and 89 to provide outward pressure on the adjustment discs 61 to increase the pressure of contact of the friction pads 71 and 73 with the friction discs 45. Downward movement of the adjustment member 81 has the opposite effect.

In the form shown, the adjustment means comprises a knob 101 threadedly engaging the upper end of member 81. The knob is rotatably mounted on the frame member 53, but is prevented from vertical movement by a collar arrangement of known design (not completely shown).

The upper end of each of the arm levers is disposed obliquely to the length of the remainder of the lever, being rearwardly inclined from the lever as the parts are shown in FIG. 1. These portions constitute grips and their rearward inclination better enable arm exercises to be carried out in an in-line fashion, rather than a required forced cocking of the wrists, that would be otherwise required.

Let it be assumed that the adjustment member 81 has been moved to a position to achieve a desired frictional resistance to movement of the levers 31 and 33. Movement of the levers, in a pulling direction, will be resisted by not only the frictional resistance at the friction discs 45, but also by resistance of the torsion springs 76.

On the other hand, when the levers 31 and 33 are being retracted toward their original positions by a pushing action of the user's arms, the torsion springs 76 seek to unwind and thus aid the arms in overcoming the frictional resistance set up by the friction discs 45. Thus a lesser resistance is met to pushing action of the user's arm than it is for pulling action. This differential resistance is in accordance with the anatomical structure of the human body, which enables a greater pulling force to be exerted than a pushing force.

The leg levers 35 and 37 are mounted in a fashion similar to that of the arm levers, i.e., on a tubular frame member 110, which is secured by hangers 111 to the frame 11, but the associated torsion springs are arranged to act differently, as will presently be apparent. Tubular frame member 110 supports the front of the frame. The frame may be sufficiently flexible to enable tubular frame member 53 to also support the frame.

Each of foot levers 35 and 37 has its own individual foot receiving element or pedal 121 pivoted at 123 on the upper end of its lever. Each pedal 121 has a strap 125 detachably connected at least at one end to enable insertion of the user's foot in a pedal and subsequent securement of the foot to the pedal with a firm effective holding action.

Referring to FIG. 1, it is pointed out that the seat portion 23 of the seat is at an angle to the horizontal, being rearwardly sloping as the parts are shown in FIG. 1, and being disposed in an off-the-floor position at a height similar to a low chair. The back portion 25 is angularly related to the seat portion, being related to the seat portion preferably to form a slightly obtuse angle.

It is therefore evident that when a person desires to use the machine, the person need only seat himself or herself in the seat 21, in a fashion in which the person would sit in a chair. In such position, considerable lumbar support is provided so that the exercises may be carried out without imposing strains on the user's lumbar region. The seat is mounted for fore and aft adjustment, so that the seat can be so located, as shown in FIG. 1, that hyperextension at the knees will not occur.

FIG. 1 shows the person P using the machine in alternating fashion, i.e., the leg on the left side being as having just completed its pushing action, while the left arm has just completed its pulling action. On the right side, the leg has just completed its retracting or pulling action, whereas the arm has just completed its pushing action.

It is pointed out that the magnitude of the frictional force is greater than the magnitude of the torsion force, so that it always takes effort to move the levers, in whatever direction they are moved.

The resistance to movement is differential, the torsion springs being arranged so that the user will meet greater resistance when pushing against the foot levers 35 and 37 than the user will in retracting such levers. To the contrary, the levers 31 and 33 are arranged so that the user meets greater resistance in pulling against the levers than in retracting them. The difference is achieved by arranging the torsion springs for the levers 31 so that they add to the frictional resistance, when pulling on the levers, but subtract from such frictional resistance when retracting them. To the contrary, the springs for the foot levers are arranged so that they add to the resistance effected by the friction brakes when pushing against the levers, and subtract from such frictional resistance when pulling on such levers to return them to their original positions.

It is still further pointed out that the resistance to movement can be at a higher level for leg exercises, and at a different and perhaps lower level for arm exercises. Furthermore, by selectively choosing an appropriate ratio of torsion spring resistance and brake resistance, the machine can be designed to obtain an effective range of resistance to achieve the desired exercising with a minimum of discomfort.

It is pointed out that when the friction resistance is increased, by turning the adjustment member 81, the magnitude of the difference between friction resistance and spring resistance is increased, because the resistance offered by the springs is unaffected by the adjustment member 81. On the other hand the differential decreases as the magnitude of the frictional resistance decreases.

Note that the machine is designed so that the user's leg cannot fully extend, thus to protect against hyperextension which can cause injury to or soreness in the knees.

The friction discs 71 and 73 are preferably made of ultra high molecular weight plastic, so that the resistance to movement is substantially uniform, rather than having high torque resistance at the commencement of movement, which is an undesirable characteristic of many friction materials.

What is claimed is:

1. An exercise machine having a frame having a front end and a rear end, said frame being of inverted V-shape in side elevation, providing a rear portion inclined downwardly rearwardly, and a front portion inclined downwardly forwardly, a forwardly oriented seat on said frame, said seat having a seat portion and an angularly related backrest portion, said seat portion being fixedly supported by said rear portion of said frame so that said seat is rearwardly tilted, with the seat portion generally paralleling the rear frame portion and the backrest portion disposed at an abrupt angle to said rear frame portion, said seat being so located relative to the apex of said frame that the knees of the user at least approximately overlie said apex, arm exercise means for performing pushing and pulling arm exercises, the arm exercise means being carried by said frame locally of said seat, and leg exercise means for performing pushing and pulling leg exercises, the leg exercise means being independent of said arm exercise means and carried by said frame locally of the front end of said frame, each exercise means having resistance means providing resistance to movement in opposite directions, the resistance means for the leg exercise means providing greater resistance to pushing forces than to pulling forces, the resistance means for the arm exercise means providing greater resistance to pulling forces than to pushing forces, said leg exercise means providing foot rest means located at the front end of said frame.

* * * * *